United States Patent [19]

Burris

[11] Patent Number: 4,981,088

[45] Date of Patent: Jan. 1, 1991

[54] SLAG ELIMINATOR FOR FURNACE VIEWING SYSTEM

[75] Inventor: Ronnie E. Burris, Lancaster, Ohio

[73] Assignee: Diamond Electronics, Inc., Carroll, Ohio

[21] Appl. No.: 523,684

[22] Filed: May 14, 1990

[51] Int. Cl.[5] ..... F23H 5/24

[52] U.S. Cl. ..... 110/193; 110/182.5; 431/13

[58] Field of Search ..... 110/193, 182.5, 185; 431/13

[56] References Cited

U.S. PATENT DOCUMENTS

| | | | |
|---|---|---|---|
| 3,609,236 | 9/1971 | Heilman | 178/7.92 |
| 4,432,286 | 2/1984 | Witte | 110/193 |
| 4,653,409 | 3/1987 | Eriksson | 119/182.5 |
| 4,748,004 | 5/1988 | Goodspeed | 422/285 |
| 4,759,299 | 7/1988 | Kennedy et al. | 110/193 |
| 4,846,080 | 7/1989 | Ross et al. | 110/182.5 |

*Primary Examiner*—Edward G. Favors

*Attorney, Agent, or Firm*—Biebel, French & Nauman

[57] ABSTRACT

An anti-slagging apparatus for a furnace viewing system removes slag build up deposited on a closed circuit television camera lens tube by occasionally releasing a blast or large volume of air through specially designed ports surrounding the tube containing a furnace viewing lens system. The anti-slagging apparatus comprises a double walled cylindrical tube extending through a wall of a furnace for housing a lens tube assembly. An end plate is positioned at the furnace end of the tube and has formed therein a plurality of ports or openings, with each port being directed outwardly at a 30° angle with respect to the axis of the tube assembly into the furnace and with each port being connected to the space formed between the double walled tube. A source of air is provided to the ports from a supply tank, which in turn is connected to a source of air pressure, such as a compressor, or a shop supply. A quick acting, high volume solenoid valve connects the air tank to the tube. When the valve is opened, a high volume of air, in the order of 1610 scfm, passes through the ports to remove the slag or other debris. An adjustable timer controls the opening of said valve, with the valve normally being opened for 1 to 2 seconds at 1 to 10 minute intervals to provide the sudden release of a large quantity of air from the tank into the ports.

5 Claims, 4 Drawing Sheets

SLAG ELIMINATOR FOR FURNACE VIEWING SYSTEM

BACKGROUND OF THE INVENTION

This invention relates to an apparatus for removing slag build up on the lens of a furnace viewing system.

Optical access through into the interior of a furnace is often necessary to diagnose the operation of a combustor or other energy conversion reactors. However, the atmosphere within such furnaces is such that materials often condensate or accumulate on the opening into the furnace used with a viewing or monitoring system, and this debris can obscure the view within a few minutes of operation.

There have been several systems proposed for removing the slag buildup, as illustrated in U.S. Pat. Nos. 3,609,236, 4,432,286, 4,748,004 and 4,759,299. These patents show the use of purging gases to maintain the passageway free of debris or the use a deslagging shifting blade mounted upon a viewing system to remove built up slag from the port.

SUMMARY OF THE INVENTION

This invention relates to an anti-slagging apparatus for a furnace viewing system to remove slag build up deposited on the closed circuit television camera lens tube.

In the present invention, a blast or large volume of air is occasionally released through specially designed ports surrounding the tube containing a furnace viewing lens system. The ports are formed in an end plate and direct the blast or air radially outwardly from the tube to remove any slag that might be building up.

Specifically, the anti-slagging apparatus for a furnace viewing system of this invention comprises a double walled cylindrical tube extending through a wall of a furnace for housing a lens tube assembly. An end plate is positioned at the furnace end of the tube and has formed therein a plurality of ports or openings, up to sixteen in the present invention, with each port being directed outwardly at a 30° angle with respect to the axis of the tube assembly into the furnace and with each port being connected to the space formed between the double walled tube. A source of air is provided to the ports by a 20 gallon supply tank, which in turn is connected to a source of air pressure, such as a compressor, or a shop supply. Typically, the air tank is pressurized to a pressure of from 80 to 100 psi. A quick acting, high volume solenoid valve connects the air tank to the tube. When the valve is opened, a high volume of air, in the order of 1610 scfm, passes through the ports to remove the slag or other debris. An adjustable time controls the opening of said valve, with the valve normally being opened at 1 to 10 minute intervals to provide the sudden release of a large quantity of air from the tank into the ports. The valve normally remains open for approximately 1 to 2 seconds and can be adjusted to remain open from 1 to 10 seconds.

The use of the anti-slagging apparatus of the present invention therefore eliminates the need to mount a deslagging shifting blade or purging the lens tube with clean gas in order to ensure continuous viewing within a furnace or and other hazardous chamber. Since the solenoid valve is used with a timer, it requires no hands on operation. Further, there are no moving parts inside the critical area of the furnace. This invention uses existing furnace viewing ports or camera lens viewing ports thereby allowing the retrofit of existing camera wall box assemblies.

Therefore, it is an object of this invention to provide an improved apparatus for eliminating slag build up on furnace viewing systems.

A further object of this invention is to provide a variable time controlled release of high pressured air from an air source to the end plate of the present invention.

Another object of this invention is to provide an end plate means forming a plurality of openings or ports at and surrounding a lens tube.

It is still another object of this invention to provide an anti-slagging apparatus for a furnace viewing system that comprises a double walled cylindrical tube extending through a wall of a furnace for housing a lens tube assembly, an end plate means forming a plurality of openings in said plate mounted at the end of cylindrical tube and positioned within the furnace, means forming a plurality of openings in said end plate in communications with the space between the double walled tube, a supply tank of air connected to a source of air pressure, valve means for connecting said tank to said tube, and timer means for controlling the opening of said valve to provide a sudden release of a large quantity of air from said source to said openings thereby to remove any slag that might form on said cylindrical tube.

Other objects and advantages of the invention will be apparent from the following description, the accompanying drawings and the appended claims.

DESCRIPTION OF THE PREFERRED EMBODIMENT

Figure 1:
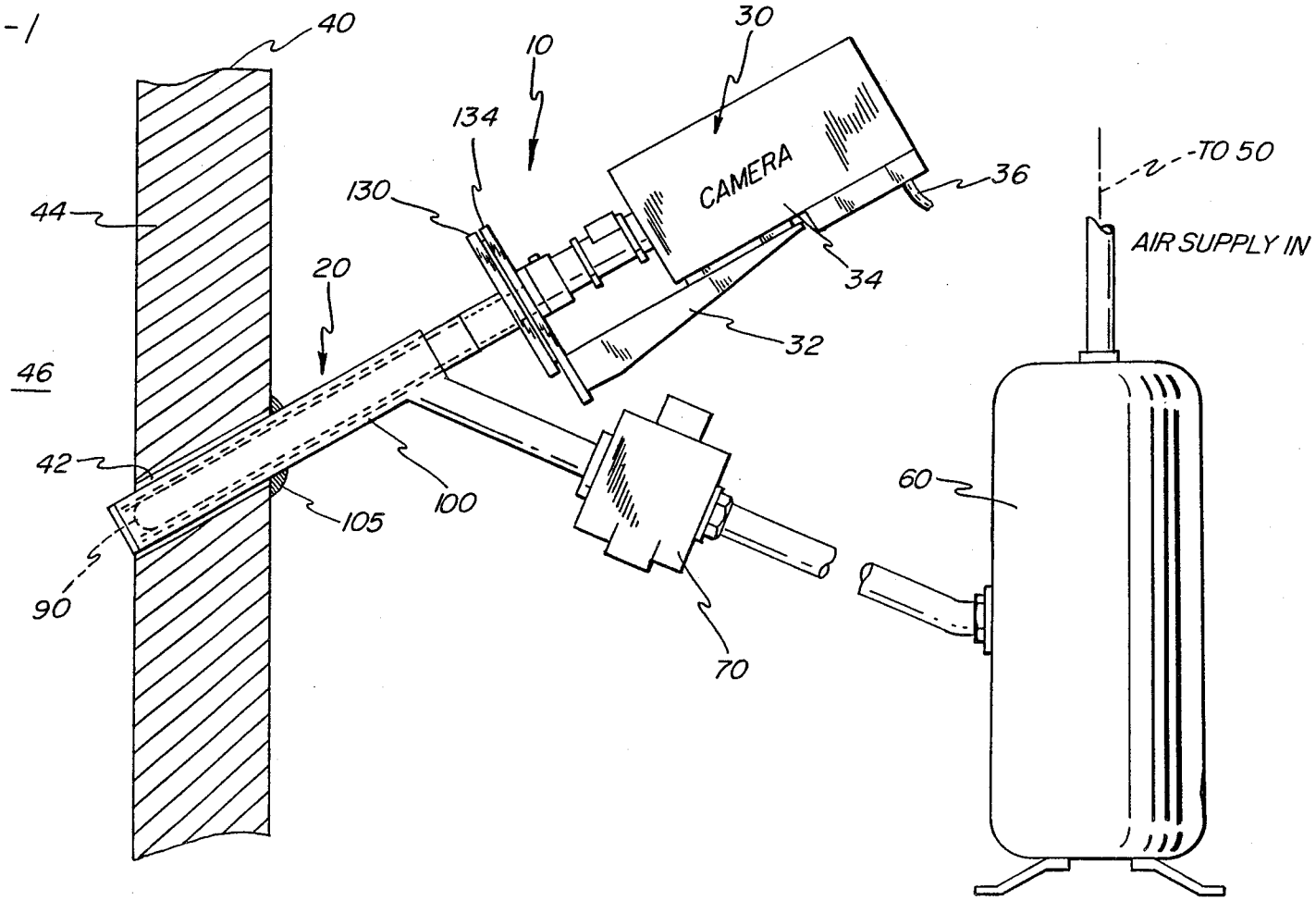
FIG. 1 is an elevational view showing the installation of a typical furnace viewing system using the anti-slagging apparatus of the present invention.

Referring now to the drawings which show a preferred embodiment of this invention, and particularly to FIG. 1, a furnace viewing system, shown generally at 10, includes a anti-slagging assembly 20, and a camera unit 30 mounted to a furnace 40. The anti-slagging assembly 20 is installed in an opening 42 formed in a wall 44 of furnace 40. The furnace viewing system 10 is so oriented that the preferred portion of the furnace interior 46 is viewed by the camera unit 30.

Also shown in FIG. 1 is an air tank 60 which is connected to a source of air pressure 50, and a control valve 70.

The anti-slagging assembly 20 includes a double walled cylindrical tube assembly 100 that extends completely through the furnace wall 44. The anti-slagging assembly is often welded to the wall 44 at 105 to hold it in place. The invention described herein is designed for use on negative or balanced draft boilers.

The camera unit 30 shown in FIG. 1 is of conventional design and includes a mounting bracket 32 onto which the camera housing 34 secured. Extending from the camera is a lens tube assembly, shown generally as element 90, which extends from the camera into the tube assembly 100. The end of the lens tube 90 is placed to view the interior 46 of the furnace 40. An additional air supply from air line 36 is normally provided to cool the camera and the internal components of the lens tube assembly.

Figure 2:
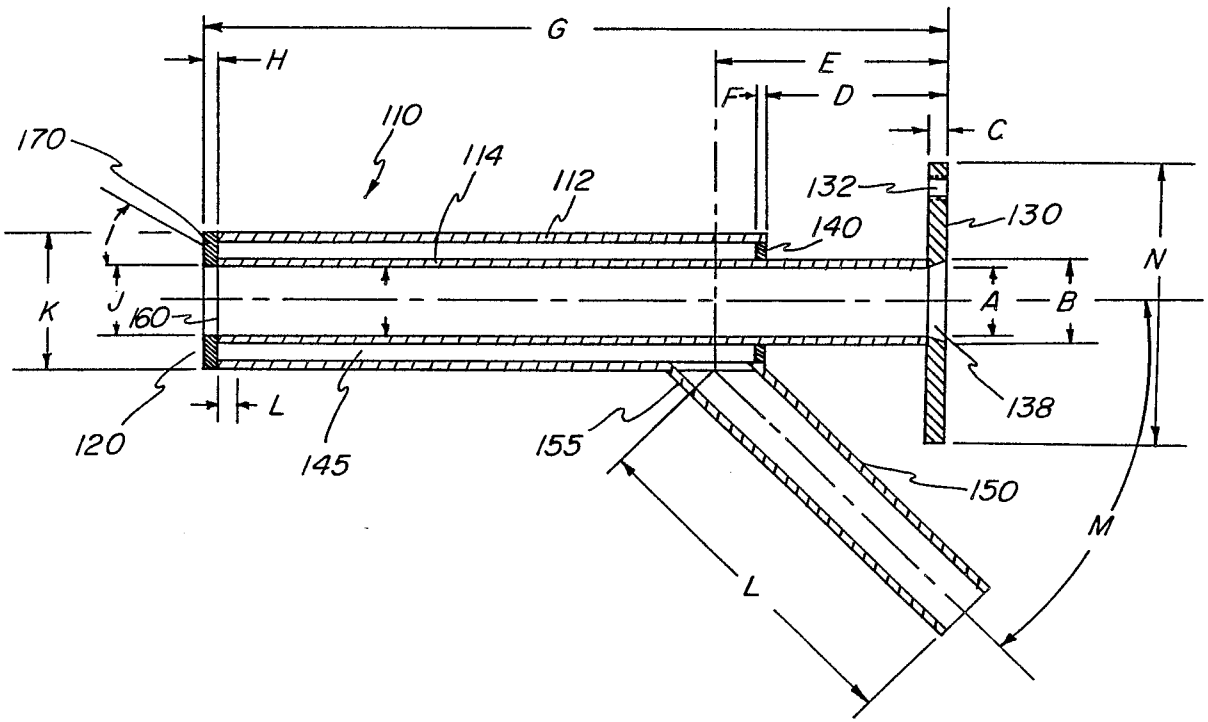
FIG. 2 is a cross-sectional elevational view of the anti-slagging apparatus of this invention.
Figure 3:
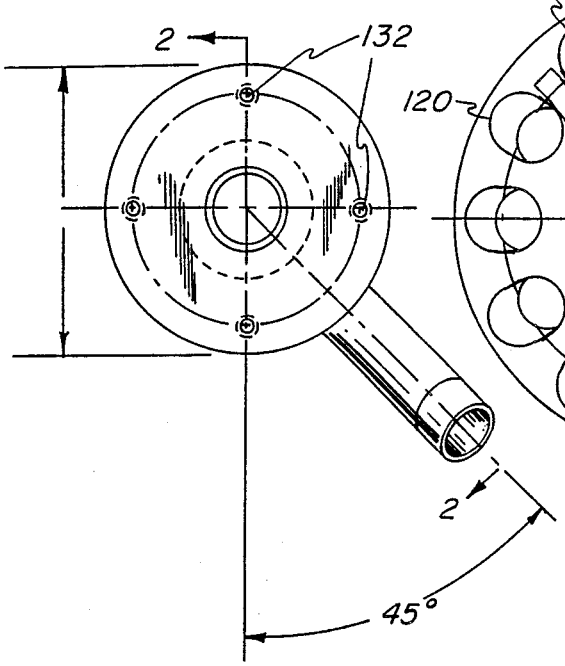
FIG. 3 is an end view from the camera end of the apparatus showing the camera attaching flange and the air inlet pipe.
Figure 4A:
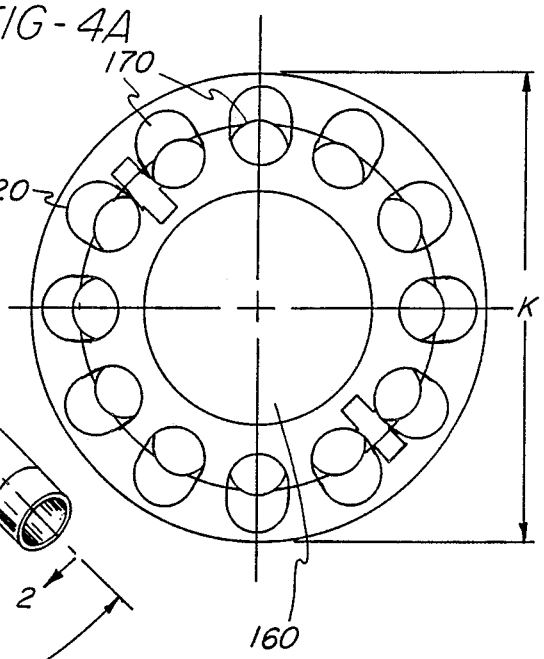
FIGS. 4A and 4b are frontal views of the end plate showing the position and angle of anti-slagging openings or ports for the two embodiments of the invention described.
Figure 4B:
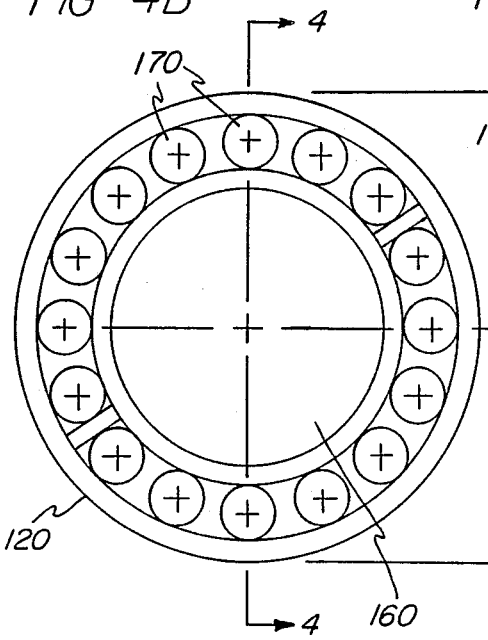
Figure 4C:
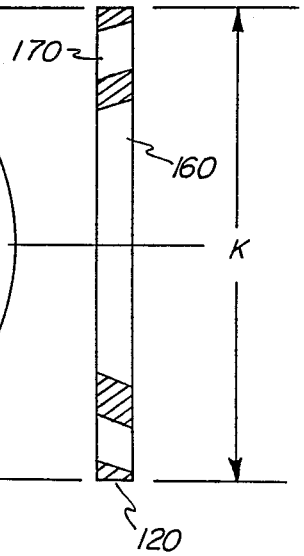
FIG. 4C is a side view takean along line 4—4 in FIG. 4B.

The cylindrical tube assembly 100 is shown in detail in FIG. 2 and includes a double walled tube section 110 comprising an outer wall 112, and an inner wall 114. At the furnace end of the tube section 110, an end plate 120 is secured by welding to both the walls 112 and 114. As better shown in FIG. 4A and 4B, a plurality of openings 170 are provided in the end plate 120. The purpose of these openings will be explained in detail later. The inner wall 114 is welded to an flange 130 at the camera end of the assembly. The flange 130 is provided with a plurality of suitable openings 132 (FIG. 3) that correspond to similar openings in flange 134 associated with the camera mounting bracket 32 to permit the camera unit to be securely attached to the anti-slagging assembly 20. The flange 130 is also provided with a central opening 138 through which the lens tube assembly 90 may freely pass.

A ring 140 is placed in the tube assembly, as shown in FIG. 2, and it is welded to both the outer wall 112 and inner wall 114 to form an air channel 145. Air is introduced into the air channel 145 by means of an air pipe 150 which is attached by welding to the outer wall 114 at 155.

The end plate 120 is provided with a central opening 160 and a plurality of circumferential openings or ports 170, typically between twelve and sixteen evenly spaced ports. The central opening permits free access by the lens tube 90. The axis of each opening 170 is preferably 30° with respect to the longitudinal axis of the tube assemble, thus directing any air introduced into the air channel 145 outwardly and away from the central opening 160.

There are two preferred embodiments of this invention, and the various dimensions (in inches and degrees) of the tube assembly 110 with reference to the letters in FIG. 2 for both embodiments are given in the following table. The preferred material is 316 stainless steel.

TABLE 1

| | 1st embodiment | 2nd embodiment |
|---|---|---|
| A | 1.88 | 2.38 |
| B | 1.61 | 2.00 |
| C | 0.50 | 0.50 |
| D | 5.13 | 5.13 |
| E | 6.50 | 6.50 |
| F | 0.125 | 0.25 |
| G | * | * |
| H | 0.188 | 0.38 |
| I | 30° | 30° |
| J | 1.70 | 2.13 |
| K | 2.63 | 4.00 |
| L | 10.00 | 10.00 |
| M | 45° | 45° |
| N | 8.25 | 8.25 |

Figure 5:
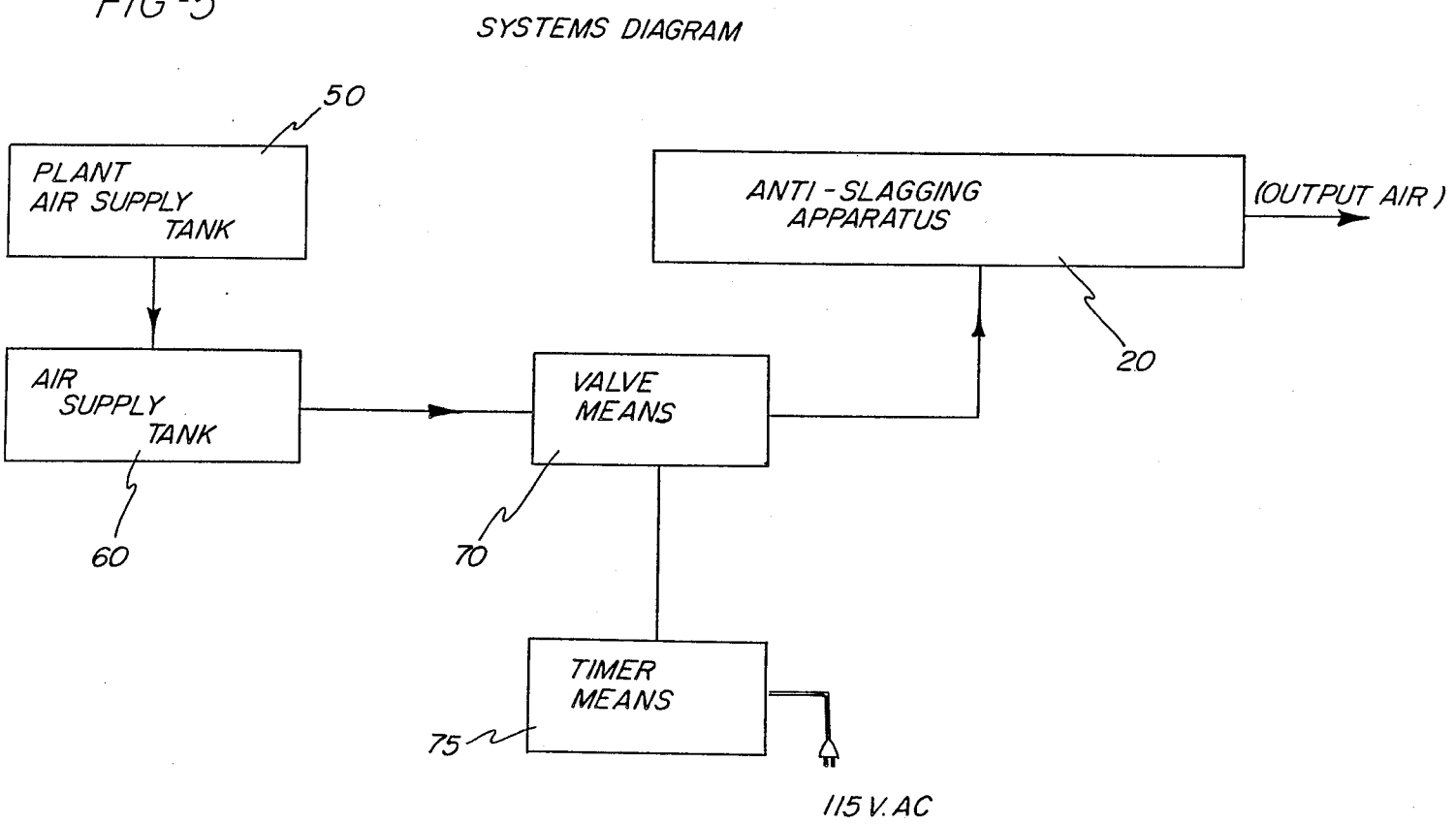
FIG. 5 is a block diagram of the anti-slagging apparatus of this invention.

Referring now to the block diagram of FIG. 5, the anti-slagging apparatus 20 of this invention receives air from a plant air supply 50 which is stored in an air supply tank 60 for future use. Typically, the air supply tank hold about 20 gallons and is pressurized to 80 to 100 psi. A quick acting, high volume solenoid valve 70 controls the flow of air from the air tank to the air channel 145. This valve may be any type that is quick acting and which can handle a large volume of air. By way of example, the valve may be a 1½" NPFT "MINI BAZOOKA," manufactured by ISI Fluid Power Inc. of Fraser MI, which can handle a maximum air flow of 1610 SCFM at 80 PSIG.

A timer 75 electronically opens and closes the valve 70, typically at a repetition rate having an adjustable period of from approximately 1 to 10 minute intervals. The timer typically holds the valve open for 1 to 2 seconds but it can be adjusted to open valve from 1 to 10 seconds.

When the valve 70 is opened by means of the timer 75, an air flow of approximately 1610 scfm will be forced into the air channel and out through the ports 170 in the end plate. This high volume of air will clean the slag buildup on the end of the tube assembly and will insure that the camera viewing lens is clear of debris, thus permitting the camera to view clearly the interior of the furnace.

While the form of apparatus herein described constitutes a preferred embodiment of this invention, it is to be understood that the invention is not limited to this precise form of apparatus and that changes may be made therein without departing from the scope of the invention, which is defined in the appended claims.

What is claimed is:

1. An anti-slagging apparatus for a furnace viewing system comprising a double walled cylindrical tube extending through a wall of a furnace for housing a lens tube assembly, an end plate mounted at the end of said cylindrical tube and positioned within the furnace, means forming a plurality of openings in said end plate in communications with a space between the double walled tube, a supply tank of air connected to a source of air pressure, valve means for connecting said tank to said tube, and said space timer means for controlling the opening of said valve means to provide a sudden release of a large quantity of air from said source to said space and said openings thereby to remove slag that might form on said cylindrical tube.

2. The apparatus of claim 1 wherein said air controlling means for directing the passage of air from said source to said openings thereby to remove any slag that might form on said cylindrical tube comprising an electrically controlled valve for allowing air to pass to said openings from said air source, an electronically-controlled timer for periodically opening said valve to allow air to pass through said valve.

3. The apparatus of claim 1 wherein said end plate at the end of said cylindrical tube positioned within the furnace comprises sixteen 5/16 inch diameter openings drilled on a 30° angle positioned circumferentially on said end plate.

4. The apparatus of claim 1 wherein said end plate at the end of said cylindrical tube positioned within the furnace comprises twelve ½ inch diameter openings drilled on a 30° angle positioned circumferentially on said end plate.

5. The apparatus of claim 1 wherein said valve means is a high volume, fast acting valve.

* * * * *